US009850589B2

(12) United States Patent
She et al.

(10) Patent No.: US 9,850,589 B2
(45) Date of Patent: Dec. 26, 2017

(54) SYSTEM AND METHODS FOR ELECTROCHEMICAL GRINDING WITH A SCREEN

(71) Applicant: UNITED TECHNOLOGIES CORPORATION, Farmington, CT (US)

(72) Inventors: Ying She, East Hartford, CT (US); Raja Kountanya, Manchester, CT (US); Changsheng Guo, South Windsor, CT (US); Daniel V. Viens, East Hartford, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 193 days.

(21) Appl. No.: 14/703,079

(22) Filed: May 4, 2015

(65) Prior Publication Data

US 2015/0322584 A1 Nov. 12, 2015

Related U.S. Application Data

(60) Provisional application No. 61/991,877, filed on May 12, 2014.

(51) Int. Cl.

| | |
|---|---|
| ***C25D 5/22*** | (2006.01) |
| ***C25C 1/00*** | (2006.01) |
| ***C25C 7/00*** | (2006.01) |
| ***C25C 7/02*** | (2006.01) |
| ***C25C 7/06*** | (2006.01) |
| ***C25D 17/10*** | (2006.01) |
| ***C25D 21/12*** | (2006.01) |
| ***C25F 3/16*** | (2006.01) |
| ***C25F 7/00*** | (2006.01) |

(52) U.S. Cl.

CPC ..... *C25D 5/22* (2013.01); *C25C 1/00* (2013.01); *C25C 7/00* (2013.01); *C25C 7/02* (2013.01); *C25C 7/06* (2013.01); *C25D 17/10* (2013.01); *C25D 21/12* (2013.01); *C25F 3/16* (2013.01); *C25F 7/00* (2013.01)

(58) Field of Classification Search

CPC .... B23H 5/06; B23H 5/08; B23H 5/10; C25C 1/00; C25C 7/00; C25C 7/02; C25F 7/00; C25F 3/16; C25D 17/10; C25D 5/22

USPC ..... 205/663

See application file for complete search history.

(56) References Cited

U.S. PATENT DOCUMENTS

| | | | | | |
|---|---|---|---|---|---|
| 3,377,150 | A * | 4/1968 | Corley | B23H 5/08 | 204/224 M |
| 4,127,459 | A * | 11/1978 | Jumer | C25F 7/00 | 204/206 |
| 4,202,739 | A * | 5/1980 | Csakvary | C25F 7/00 | 204/224 M |
| 4,405,421 | A * | 9/1983 | Inoue | B23H 5/08 | 204/217 |

(Continued)

*Primary Examiner* — Keith Hendricks
*Assistant Examiner* — Joshua Allen
(74) *Attorney, Agent, or Firm* — Cantor Colburn LLP

(57) ABSTRACT

A system and methods are provided for electrochemical grinding a workpiece. In one embodiment, a method includes controlling potentials to grinding tool and the workpiece, controlling applying electrolyte, and controlling grinding of the workpiece by the grinding tool. The method may also include determining screen replacement when there is sufficient metal plated.

18 Claims, 6 Drawing Sheets

(56) References Cited

U.S. PATENT DOCUMENTS 6,113,464 A * 9/2000 Ohmori ..... B24B 53/001
451/41
2008/0242202 A1* 10/2008 Wang ..... B23H 5/08
451/287

* cited by examiner

SYSTEM AND METHODS FOR ELECTROCHEMICAL GRINDING WITH A SCREEN

CROSS-REFERENCE TO RELATED APPLICATIONS

This application claims priority to U.S. Provisional Application No. 61/991,877 filed on May 12, 2014 and titled System and Methods for Electrochemical Grinding with a Screen, the disclosure of which is hereby incorporated by reference in its entirety.

FIELD

The present disclosure relates generally to grinding processes for material removal, and more particularly to a system and methods for electrochemical grinding with a screen element.

BACKGROUND

Grinding processes are employed to remove material from components for manufacture and finishing. Conventional methods of finishing and shaping aerospace components have employed grinding for high strength materials. One processing limitation of traditional grinding tools is the time required for grinding. Traditional grinding methods may be less effective with hardened or temperature resistant materials. While there have been improvements to grinding techniques, tool life and surface quality continues to be a concern. By way of example, traditional grinding may result in stresses or defects in components.

BRIEF SUMMARY OF THE EMBODIMENTS

Disclosed and claimed herein are a system and methods for electrochemical grinding. One embodiment is directed to an electrochemical grinding tool. The electrochemical grinding tool includes a grinding element having a grinding surface, wherein the grinding element is configured to be electrically coupled to a cathode of a voltage source. The grinding tool also includes a screen coupled to the grinding element, wherein the screen is configured to be electrically coupled to the cathode of the voltage source, and wherein the screen is configured to recover material by electroplating removed by the grinding element during electrochemical grinding.

Another embodiment is directed to an electrochemical grinding system. The grinding system includes a grinding tool including a grinding element having a grinding surface, wherein the grinding element is configured to be electrically coupled to a cathode of the voltage source. The grinding system also includes a screen coupled to the grinding element, wherein the screen is configured to be electrically coupled to the cathode of the voltage source, and wherein the screen is configured to recover material by electroplating removed by the grinding element during electrochemical grinding. The system also includes a controller configured to control the grinding tool for electrochemical grinding of a workpiece.

In one embodiment, a method is provided for electrochemical grinding. The method includes controlling a potential of a voltage source applied to a grinding tool, wherein the grinding tool includes a screen coupled to a grinding element and wherein the screen is electrically coupled to the cathode of the voltage source. The method also includes controlling a potential of the voltage source applied to a workpiece and controlling electrochemical grinding of the workpiece by the grinding tool, wherein the screen is configured to recover material by electroplating removed by the grinding element during electrochemical grinding.

Other aspects, features, and techniques will be apparent to one skilled in the relevant art in view of the following detailed description of the embodiments.

BRIEF DESCRIPTION OF THE DRAWINGS

The features, objects, and advantages of the present disclosure will become more apparent from the detailed description set forth below when taken in conjunction with the drawings in which like reference characters identify correspondingly throughout and wherein.

DETAILED DESCRIPTION OF THE EXEMPLARY EMBODIMENTS

Overview and Terminology

One aspect of the disclosure relates to systems and methods for grinding. In particular, systems and methods are provided for electrochemical grinding. In one embodiment, an electrochemical grinding tool is provided including a grinding element and a screen coupled to the grinding element. According to other embodiments, a system is provided for electrochemical grinding employing a grinding tool with a screen. In other embodiments, methods are provided for electrochemical grinding with a screen.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

Figure 1A:
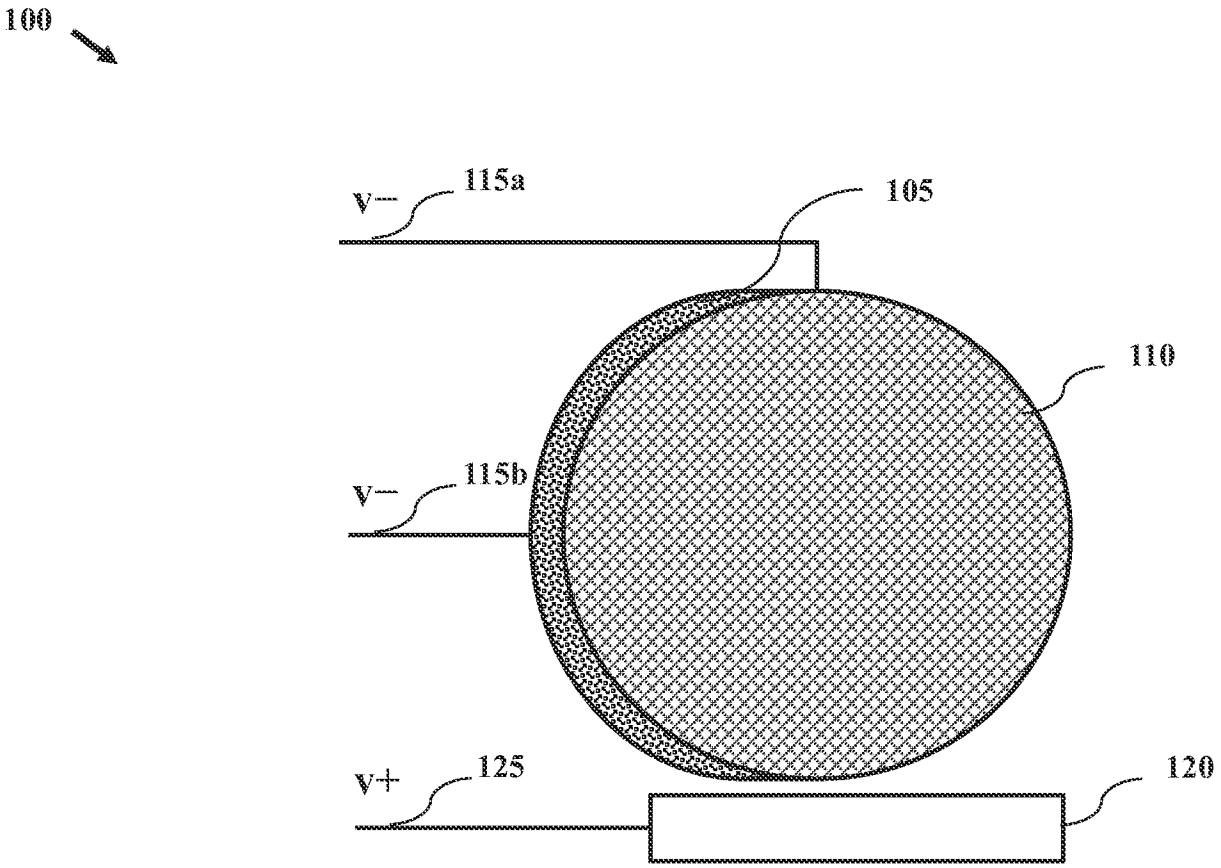
FIGS. 1A-1B depict graphical representations of a grinding tool according to one or more embodiments.
Figure 1B:
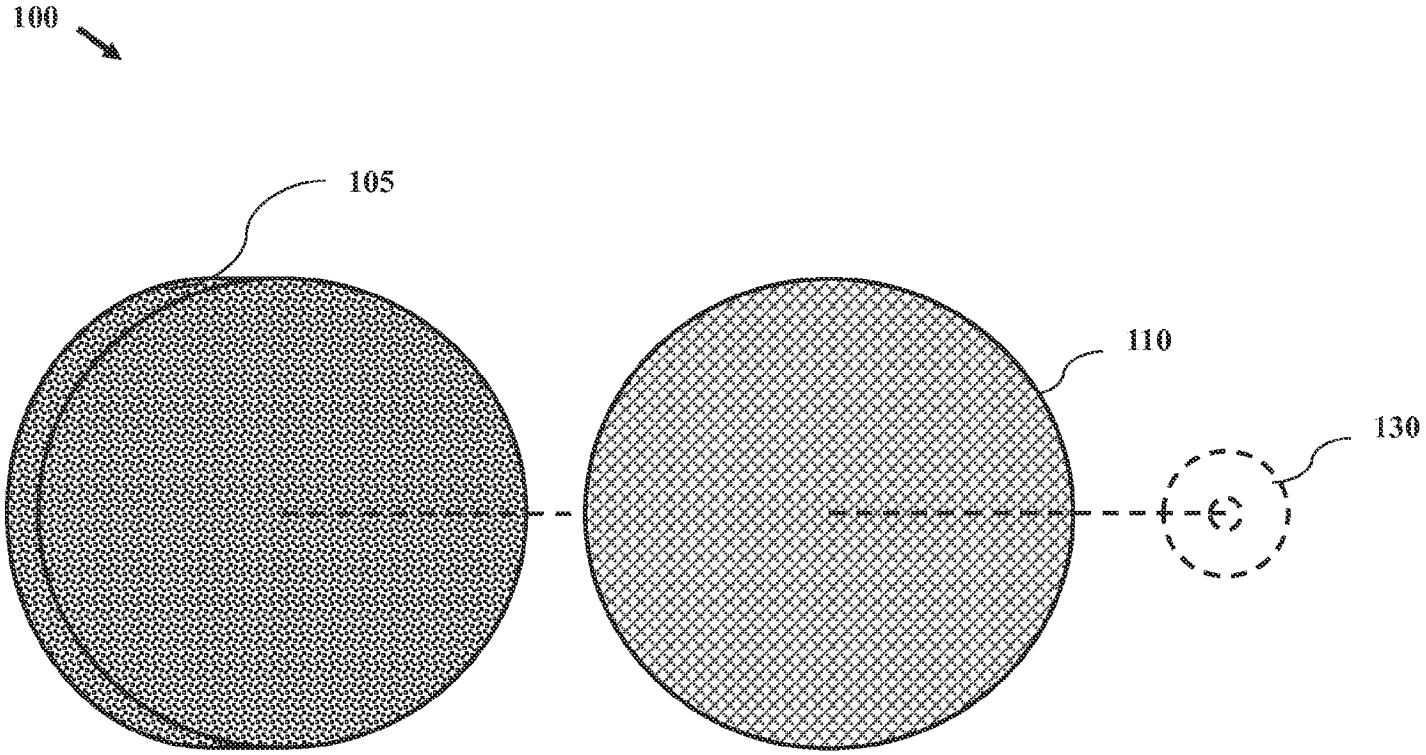

Referring now to the figures, FIGS. 1A-1B depict graphical representations of a grinding tool according to one or more embodiments. FIG. 1A depicts electrochemical grinding tool 100 including grinding element 105 and screen 110. Grinding element 105 includes a grinding surface for removing material from one or more components. According to one embodiment, grinding element 105 may be a grinding wheel including abrasive material on the grinding surface.

Grinding element 105 is configured to be electrically coupled to a cathode of a voltage source, such as potential connection 115*a*. Screen 110 is electrically and mechanically coupled to grinding element 105. According to one embodiment, screen 110 may be configured to be electrically coupled to the cathode of a voltage source. Screen 110 may be configured to recover material by the electroplating removed by the grinding element during electrochemical grinding.

Grinding tool 100 may be configured to remove material from one or more elements, such as workpiece 120. By way of example, workpiece 120 may relate to one or more components, including but not limited to blades, bearings, vanes, housings, and jet engine components in general.

According to one embodiment, grinding tool 100 may be coupled to a voltage source during electrochemical grinding. By way of example, grinding tool 100 may be coupled to the cathode of a voltage source and workpiece 120 may be coupled to an anode of the voltage source. As shown in FIG. 1A, grinding element 105 is electrically coupled to potential connection 115*a* and screen 110 is electrically coupled to potential connection 115*b* of voltage source (e.g., cathode connections). Workpiece 120 is electrically coupled to potential connection 125 of a voltage source (e.g., anode connections).

According to one embodiment, screen 110 may be configured to recover material removed by grinding element 105 during electrochemical grinding. Screen 110 may be removeably coupled to grinding element 105. FIG. 1B depicts a graphical representation of grinding tool 100 in a disassembled view according to one or more embodiments. According to one embodiment, grinding element 105 may be a grinding wheel and screen 110 may be a metal mesh disk configured to be coupled to a surface of grinding element 105. Screen 110 may be removable to allow for a replacement screen to be applied to grinding element 105. FIG. 1B depicts optional connection element 130 which may be configured to couple screen 110 to a surface of grinding element 105.

Figure 2B:
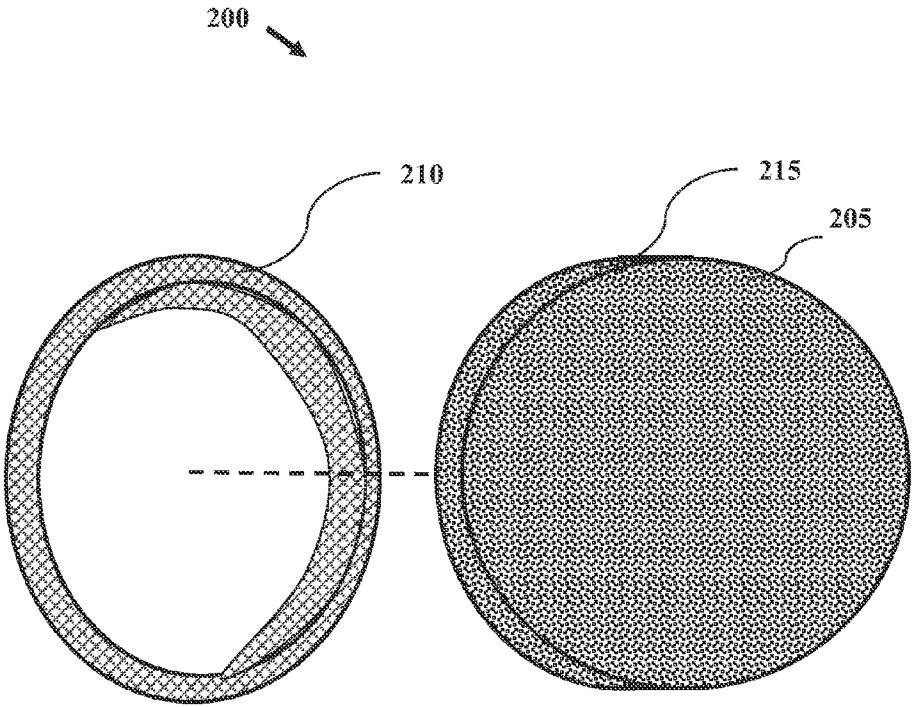
FIGS. 2A-2C depict graphical representations of a grinding tool and screen according to one or more embodiments.
Figure 2A:
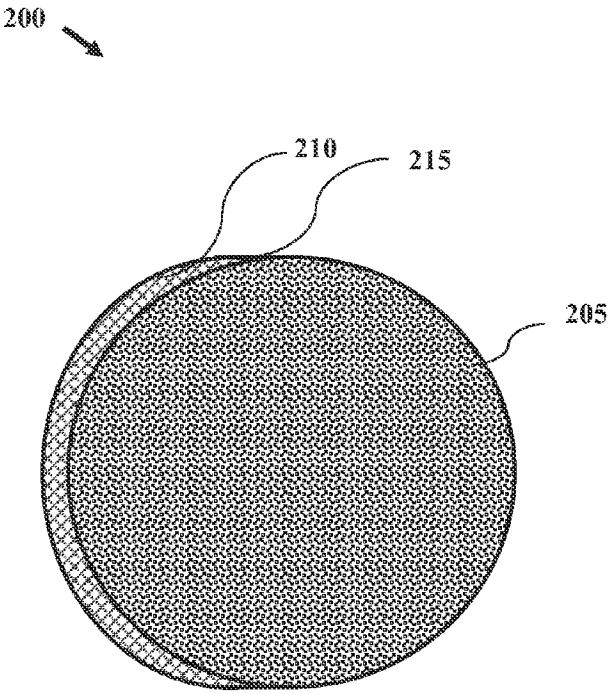
Figure 2C:
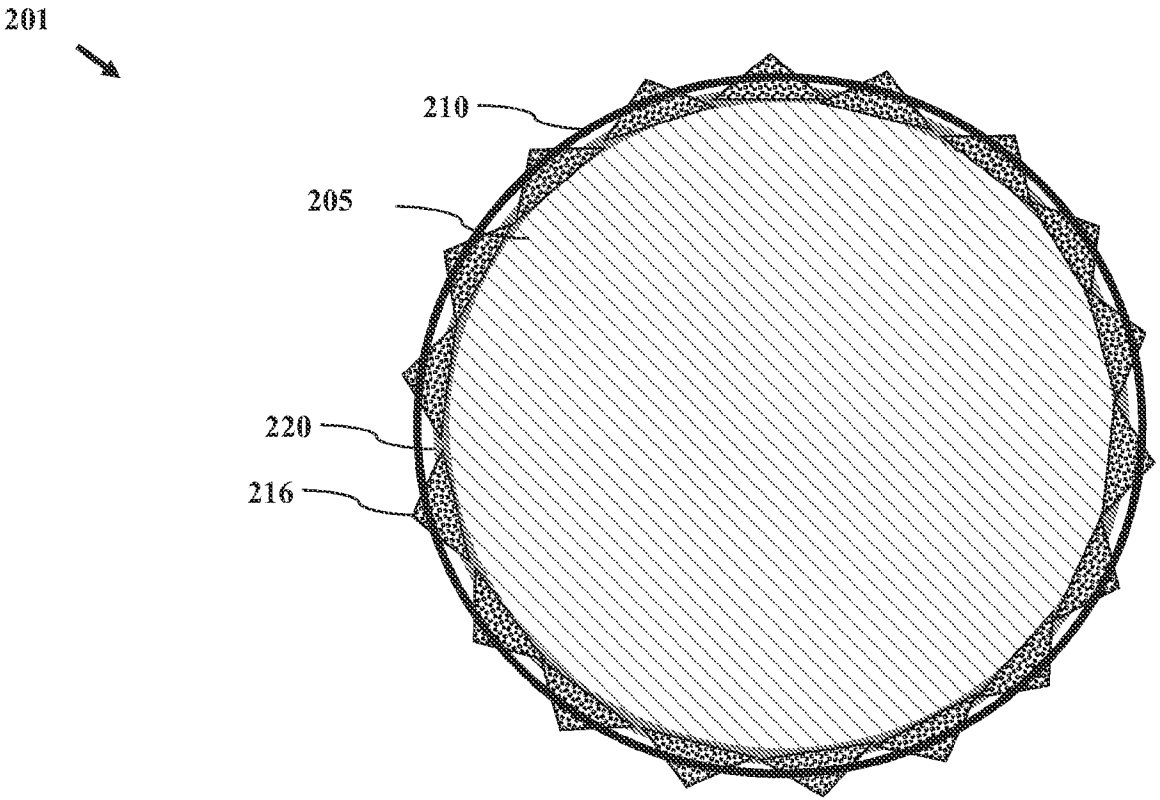

Referring now to FIGS. 2A-2C, graphical representations of a grinding tool and screen are depicted according to one or more embodiments. According to one embodiment, FIGS. 2A-2C depict a grinding tool having a screen configured to the contour of the outer or grinding surface of a grinding element. The grinding tool of FIGS. 2A-2C may be similarly coupled to potentials of a voltage source as grinding tool 100 of FIGS. 1A-1B.

FIG. 2A depicts electrochemical grinding tool 200 including grinding element 205 and screen 210. Grinding element 205 includes grinding surface 215 for removing material from one or more components. According to one embodiment, grinding element 205 may be a grinding wheel including abrasive material on grinding surface 215. Grinding element 205 is configured to be electrically coupled to a cathode of a voltage source. Screen 210 is coupled to grinding element 205. According to one embodiment, screen 210 may be configured to be electrically coupled to the cathode of a voltage source. Screen 210 may be configured to recover material removed by the electroplating by the grinding element during electrochemical grinding.

FIG. 2B depicts electrochemical grinding tool 200 including grinding element 205 and screen 210 removed from grinding element 205. According to one embodiment, screen 210 is a metal mesh contoured to grinding surface 215 of the grinding element 205.

FIG. 2C depicts a cross-sectional representation of electrochemical grinding tool 200 shown as grinding tool 201 including grinding element 205 and screen 210, abrasive 216 applied to a grinding surface and bonding material 220.

According to one embodiment, abrasive 216 includes at least one of a nonconductive material, diamond and aluminum oxide material. Abrasive 216 may be bonded to grinding element 205 by bonding material 220. In certain embodiments, grinding element 205 includes nonconductive material, diamond and aluminum oxide material, bonded together by a bonding material such as nickel. According to another embodiment, screen 210 includes a plurality of openings to allow abrasive material 216 of grinding element 205 engage with a workpiece (e.g., workpiece 120).

It should be appreciated that grinding tools 200 and 201 of FIGS. 2A-2C may be different embodiments of the grinding tool of FIGS. 1A-1B wherein elements and attributes of the grinding tools may be similarly applied.

Figure 3:
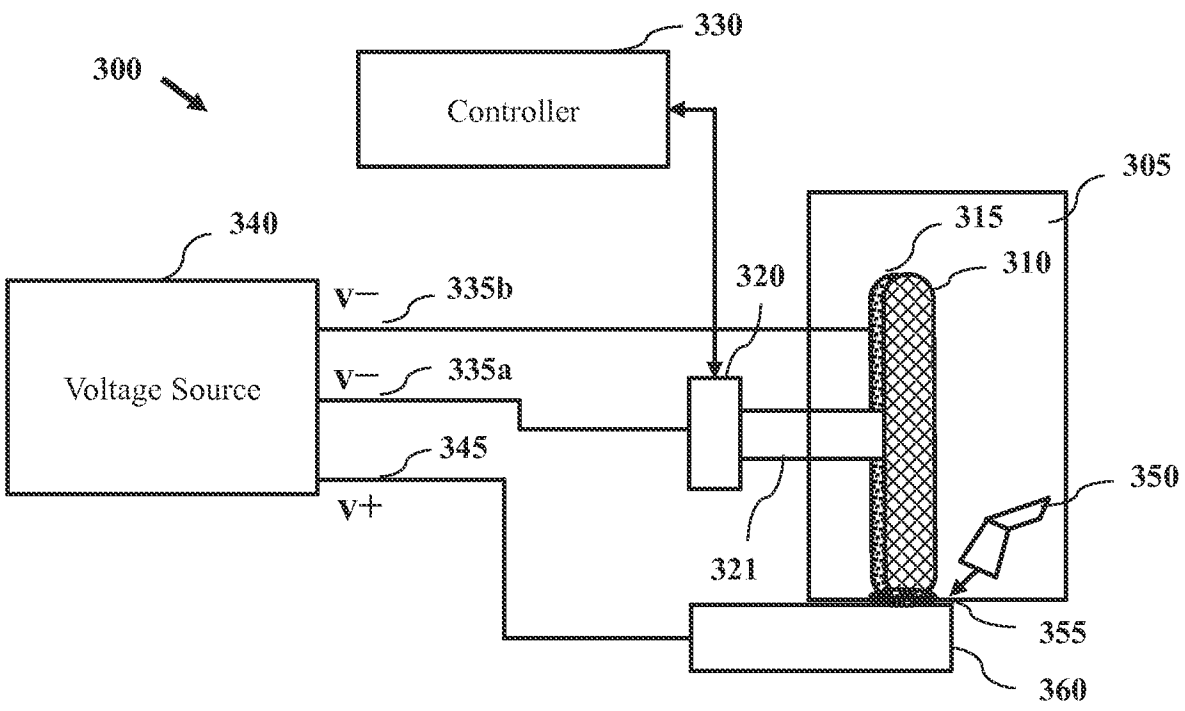
FIG. 3 depicts a simplified system diagram according to one or more embodiments.

FIG. 3 depicts a simplified system diagram according to one or more embodiments. According to one embodiment, system 300 may employ one or more grinding tools described herein for electrochemical grinding. Electrochemical grinding system 300 includes a grinding tool 305 and controller 330.

According to one embodiment, grinding tool 305 includes grinding element 310, such as a grinding wheel, having a grinding surface. The grinding surface of grinding element 310 may include an abrasive material. In certain embodiments, grinding element 310 includes nonconductive material, diamond and aluminum oxide material, bonded together by a bonding material such as nickel. In another embodiment, grinding tool 305 includes screen 315 coupled to grinding element 310. Screen 315 is configured to recover material by the electroplating removed by the grinding element 310 during electrochemical grinding.

Controller 330 may be configured to control grinding tool 305 for electrochemical grinding of workpiece 360 including potential applied and control of grinding tool 305. In one embodiment, grinding tool 305 may be rotated by drive unit 320 via shaft 321. Controller 330 may be configured to control drive unit 320 for control of rotational speed for grinding tool 305. Controller 330 may be configured to control drive unit 320 in order to rotate one or more grinding tools. Grinding element 310 is configured to be electrically coupled to a cathode of the voltage source 340, as shown by connection 335*a*. Screen 315 is configured to be electrically coupled to a cathode of voltage source 340, as shown by connection 335*b*. Workpiece 360 is configured to be electrically coupled to an anode of voltage source 340, as shown by connection 345. According to one embodiment, screen 315 may have a different electric potential than the grinding element 310. In certain embodiments, screen 315 is insulated from grinding element 310 if there are different potentials.

During electrochemical grinding, an electric current generated by voltage source 340 is passed through electrolyte 355, which may be a small gap (e.g., a 0.001" gap) between workpiece 360 and grinding tool 305. According to one embodiment, voltage source 340 can be a DC power supply of 4-14 volts, DC current can be 50-3000 A with current density 500-1500 A/in$^2$.

System 300 may include nozzle 350 configured to apply the electrolyte 355 in the gap between workpiece 360 and grinding tool 305. Controller 330 may be configured to control electrochemical grinding by applying an electrolyte in between workpiece 360 and grinding tool 305. In other embodiments, system 300 may include placing workpiece 360 and grinding tool 305 in a reservoir (not shown) filled with a selected electrolyte and medium.

Figure 4:
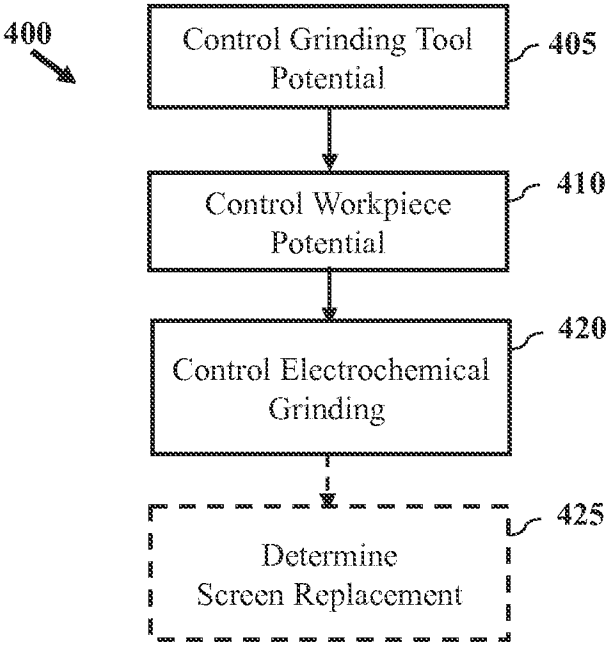
FIG. 4 depicts a process for electrochemical grinding according to one or more embodiments.

FIG. 4 depicts a process for electrochemical grinding according to one or more embodiments. Process 400 may be employed by a machine/apparatus for grinding, such as the system of FIG. 3. Process 400 may include controlling a potential of a voltage source applied to a grinding tool at block 405. A screen coupled to a grinding element of a grinding tool may be electrically coupled to the cathode of the voltage source and applied a potential. In one embodiment, potential applied to the screen is different than the potential applied to the grinding element. According to another embodiment, controlling potential applied to the grinding tool at block 405 includes measuring at least one of current and potential of an electrolyte solution during electrochemical grinding.

At block 410, potential of the voltage source applied to a workpiece is controlled.

At block 415, electrochemical grinding of the workpiece by the grinding tool is controlled. During electrochemical grinding, the screen is configured to recover material removed by the grinding element during electrochemical grinding. Controlling electrochemical grinding at block 415 can include controlling potential applied to the screen.

Controlling electrochemical grinding at block 415 can include applying electrolyte in between a grinding tool and workpiece. In one of embodiment, the electrolyte may be sprayed by a nozzle. In another embodiment, the electrolyte may be applied by placing the workpiece and the grinding tool in a reservoir filled with a selected electrolyte, for example, sodium chloride, sodium nitride and rust inhibitor. A selected electrolyte may depend on material to be ground. Controlling at block 415 may include selecting an appropriate electrolyte and its medium to allow metal ions generated from the workpiece (anode) in the electrochemical grinding process not to form metal hydroxide/metal oxide rather to exist in ions forms or coordinated with other ion groups in the electrolyte medium so the metal ions travel to the cathode side and electroplated on the cathode as the metal.

Controlling electrochemical grinding at block 415 can include adjusting one or more of the grinding speed, angle and position of the grinding tool. Positioning the grinding tool and the workpiece may also include leave a gap between the grinding tool and the workpiece, such as a distance is 0.001" so that the electrolyte can be applied during grinding.

Process 400 may optionally determine a condition requiring screen replacement at block 420. During grinding, metals may accumulate on the screen. During electrochemical grinding process 400, when excessive metal is plated on the screen, the screen is replaced and the metal may be recycled.

While this disclosure has been particularly shown and described with references to exemplary embodiments thereof, it will be understood by those skilled in the art that various changes in form and details may be made therein without departing from the scope of the claimed embodiments.

What is claimed is:

1. An electrochemical grinding tool comprising:

a voltage source including an anode and a cathode, the anode being electrically coupled to a workpiece;

a grinding wheel having a grinding surface, wherein the grinding wheel is electrically coupled to the cathode of the voltage source, and wherein the grinding wheel includes abrasive material on the grinding surface; and a screen coupled to the grinding wheel, wherein the screen is configured to be electrically coupled to the cathode of the voltage source, wherein the screen is configured to recover material by electroplating removed by the grinding wheel during electrochemical grinding, wherein the screen encircles the grinding wheel and partially encloses the abrasive material on the grinding surface, and wherein a portion of the abrasive material extends radially outward beyond the screen to allow the portion of the abrasive material to engage with the workpiece.

2. The electrochemical grinding tool of claim 1, wherein the abrasive material includes at least one of a nonconductive material, diamond and aluminum oxide material.

3. The electrochemical grinding tool of claim 1, wherein the screen is a metal mesh contoured to the grinding surface of the grinding wheel.

4. The electrochemical grinding tool of claim 1, wherein the screen is a metal mesh disk coupled to an outer surface of the grinding wheel.

5. The electrochemical grinding tool of claim 1, wherein the screen includes a plurality of openings to allow the portion of the abrasive material of the grinding wheel to engage with the workpiece.

6. The electrochemical grinding tool of claim 1, wherein the screen is configured to be removable from the grinding wheel.

7. An electrochemical grinding system comprising:

a grinding tool including a voltage source including an anode and a cathode, the anode being electrically coupled to a workpiece;

a grinding wheel having a grinding surface, wherein the grinding wheel is electrically coupled to the cathode of the voltage source, and wherein the grinding wheel includes abrasive material on the grinding surface; and a screen coupled to the grinding wheel, wherein the screen is configured to be electrically coupled to the cathode of the voltage source, wherein the screen is configured to recover material by electroplating removed by the grinding wheel during electrochemical grinding, wherein the screen encircles the grinding wheel and partially encloses the abrasive material on the grinding surface, and wherein a portion of the abrasive material extends radially outward beyond the screen to allow the portion of the abrasive material to engage with the workpiece; and a controller configured to control the grinding tool for electrochemical grinding of the workpiece.

8. The electrochemical grinding system of claim 7, wherein the abrasive material includes at least one of a nonconductive material, diamond and aluminum oxide material.

9. The electrochemical grinding system of claim 7, wherein the screen is a metal mesh contoured to the grinding surface of the grinding wheel.

10. The electrochemical grinding system of claim 7, wherein the screen is a metal mesh disk coupled an outer surface of the grinding wheel.

11. The electrochemical grinding system of claim 7, wherein the screen includes a plurality of openings to allow the portion of the abrasive material of the grinding wheel to engage with the workpiece.

12. The electrochemical grinding system of claim 7, wherein the screen is configured to be removable from the grinding wheel.

13. A method for electrochemical grinding, the method comprising:

controlling a potential of a voltage source applied to a grinding tool, wherein the grinding tool includes a screen coupled to a grinding wheel having a grinding surface and abrasive material on the grinding surface, wherein the voltage source includes an anode and a cathode, and wherein the screen is electrically coupled to the cathode of the voltage source;

electrically coupling the anode to a workpiece;

electrically coupling the grinding wheel to the cathode of the voltage source;

encircling the grinding wheel with the screen, wherein the screen partially encloses the abrasive material on the grinding surface and wherein a portion of the abrasive material extends radially outward beyond the screen to allow the portion of the abrasive material to engage with the workpiece;

controlling a potential of the voltage source applied to the workpiece; and controlling electrochemical grinding of the workpiece by the grinding tool, wherein the screen is configured to recover material by electroplating removed by the grinding wheel during electrochemical grinding.

14. The method of claim 13, wherein potential applied to the screen is different than the potential applied to the grinding wheel.

15. The method of claim 13, wherein controlling of potential applied to the grinding tool includes measuring at least one of current and potential of an electrolyte solution during electrochemical grinding.

16. The method of claim 13, wherein controlling electrochemical grinding includes controlling potential applied to the screen.

17. The method of claim 13, wherein controlling electrochemical grinding includes adjusting one or more of the grinding speed, angle and position of the grinding tool.

18. The method of claim 13, further comprising determining a condition requiring screen replacement.

* * * * *